US011331709B1

(12) United States Patent
Zhang et al.

(10) Patent No.: US 11,331,709 B1
(45) Date of Patent: May 17, 2022

(54) ELASTIC DOUBLE-SUPPORT VARIABLE-DIAMETER MANDREL FOR BENDING OF AIRCRAFT ENGINE-SPECIFIC METAL CONDUIT

(71) Applicant: ZHEJIANG UNIVERSITY, Hangzhou (CN)

(72) Inventors: Shuyou Zhang, Hangzhou (CN); Zili Wang, Hangzhou (CN); Guodong Yi, Hangzhou (CN); Mengyu Fu, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 0 days.

(21) Appl. No.: 17/599,686

(22) PCT Filed: Jun. 9, 2020

(86) PCT No.: PCT/CN2020/095153
§ 371 (c)(1),
(2) Date: Sep. 29, 2021

(87) PCT Pub. No.: WO2020/228840
PCT Pub. Date: Nov. 19, 2020

(30) Foreign Application Priority Data

May 13, 2019 (CN) ..... 201910391738.8

(51) Int. Cl.
*B21D 9/01* (2006.01)

(52) U.S. Cl.
CPC ..... *B21D 9/01* (2013.01)

(58) Field of Classification Search
CPC ... B21D 9/00; B21D 9/01; B21D 9/03; B21D 9/15; B21D 26/033
(Continued)

(56) References Cited

U.S. PATENT DOCUMENTS 2,908,940 A * 10/1959 Jones ..... B21D 9/01 24/115 N
3,180,130 A * 4/1965 Avera ..... B21D 9/01 72/701
(Continued)

FOREIGN PATENT DOCUMENTS

CN 103341536 A 10/2013
CN 203599321 U 5/2014
(Continued)

*Primary Examiner* — Edward T Tolan
(74) *Attorney, Agent, or Firm* — Bayramoglu Law Offices LLC

(57) ABSTRACT

An elastic double-support variable-diameter mandrel for bending of an aircraft engine-specific metal conduit includes a frame receiving pipe, an elastic outer frame and an inner hydraulic component. In the inner hydraulic component, an inner chamber of an elastic membrane is filled with a liquid, a tail end of the elastic membrane is provided with an opening, the opening communicates with a first end of a liquid delivery pipe through a pipe joint, and a second end of the liquid delivery pipe is connected to an external hydraulic system. The elastic outer frame is a flexible single unit composed of a tie rod and an elastic mesh structure. The tie rod includes an elastic traction segment, a straight segment and a pull ring. The elastic mesh structure includes wavy metal strip circumferences and anti-fatigue elastic connectors. The frame receiving pipe is sleeved outside the elastic outer frame/inner hydraulic component.

6 Claims, 3 Drawing Sheets

(58) Field of Classification Search
USPC ..... 72/466.2, 466.7, 466.8
See application file for complete search history.

(56) References Cited

U.S. PATENT DOCUMENTS

| | | | | | |
|---|---|---|---|---|---|
| 5,104,404 | A * | 4/1992 | Wolff | ..... | A61F 2/89 623/1.16 |
| 5,369,973 | A * | 12/1994 | Wendorff | ..... | B29C 53/083 72/369 |
| 7,887,578 | B2 * | 2/2011 | Schneider | ..... | A61F 2/915 606/198 |
| 8,920,488 | B2 * | 12/2014 | Bregulla | ..... | A61F 2/91 623/1.16 |

FOREIGN PATENT DOCUMENTS

| | | | | | |
|---|---|---|---|---|---|
| CN | 107138569 | A | 9/2017 | | |
| CN | 110102618 | A | 8/2019 | | |
| DE | 102010007501 | A1 * | 8/2011 | ..... | B21D 9/01 |
| EP | 0901847 | A1 | 3/1999 | | |
| JP | 62-9724 | A * | 1/1987 | ..... | B21D 9/00 |
| JP | H11342427 | A | 12/1999 | | |

* cited by examiner

ELASTIC DOUBLE-SUPPORT VARIABLE-DIAMETER MANDREL FOR BENDING OF AIRCRAFT ENGINE-SPECIFIC METAL CONDUIT

CROSS REFERENCE TO THE RELATED APPLICATIONS

This application is the national phase entry of International Application No. PCT/CN2020/095153, filed on Jun. 9, 2020, which is based upon and claims priority to Chinese Patent Application No. 201910391738.8, filed on May 13, 2019, the entire contents of which are incorporated herein by reference.

TECHNICAL FIELD

The present disclosure relates to the technical field of bending die design for preventing aircraft engine-specific thin-walled bends from wrinkling and cross-section flattening, and in particular to an elastic double-support variable-diameter mandrel for bending of an aircraft engine-specific metal conduit.

BACKGROUND

As indispensable components for existing lightweight and centralized transportation pipelines, thin-walled metal bends have been widely used in the aerospace industry. An aircraft engine involves a large number of conduits. In order to save space, it is necessary to bend these conduits into various shapes to avoid interference in a limited space. Compared with ordinary bends, aircraft engine-specific metal conduits have a thinner wall and a larger bending angle, and thus are more prone to wrinkling on the inner wall of the bending part during the forming process as well as cross-section flattening and distortion of the bending part. These forming defects will cause adverse effects such as unstable delivery pressure.

At present, bending dies (mandrels) are typically used to realize the anti-wrinkling and anti-cross-section-flattening forming of aircraft engine-specific thin-walled bends. In practice, a mandrel is inserted into a pipe blank to be bent to provide support for a bending segment from the inside. As mandrels are effective dies for preventing forming defects, the structural improvement and innovation for mandrels has great significance for improving the bending quality of aircraft engine-specific metal conduits, increasing the production efficiency, and reducing the cost.

Multi-ball segment flexible mandrels have been widely used in production, where ball segments with incomplete spherical supporting surfaces are connected through spherical hinges, and thus can be bent in any direction in space along with a pipe. Such multi-ball segment flexible mandrels have the following shortcomings: (1) Since the dimension of the supporting cross section is fixed, the production of bends with different diameters requires mandrels with different diameters. However, in aerospace and other application fields, a large-diameter and thin-walled bend is typically customized individually, as a result, the corresponding mandrel cannot be reused, which greatly increases the use and storage costs of the mandrels. (2) The outer surface of each ball segment is actually in line contact with the inner wall of a bend. During the forming of a large-diameter and thin-walled bend, it is difficult to ensure the supporting effect only by the line contact since defects may still occur in a gap between the line contact. (3) Due to the limitation of the ball segment structure and the spherical hinge connection mode, the multi-ball segment flexible mandrel is not suitable for use in the case where the bending angle is large (90° to 180°), as the ball segments of the mandrel may interfere with each other. The gaps among the ball segments can be increased to avoid interference, but in fact at the expense of the supporting strength at the outer bending side.

SUMMARY

The present disclosure discloses an elastic double-support variable-diameter mandrel for bending of an aircraft engine-specific metal conduit, which realizes the variability of a radial dimension, makes the same mandrel suitable for the processing of bends with different diameters, effectively reduces a production cost, and can improve the quality of bending and prevent wrinkling during bending.

The present disclosure adopts the following technical solutions.

The mandrel of the present disclosure includes a frame receiving pipe, an elastic outer frame, and an inner hydraulic component, where the inner hydraulic component includes a liquid delivery pipe, a pipe joint, and an elastic membrane; an inner chamber of the elastic membrane is filled with a liquid, a tail end of the elastic membrane is provided with an opening, the opening communicates with one end of the liquid delivery pipe through the pipe joint, and the other end of the liquid delivery pipe is connected to an external hydraulic system; the liquid delivery pipe is configured to fill the inner chamber of the elastic membrane with a liquid; the elastic outer frame is a flexible single unit composed of a tie rod and an elastic mesh structure. The tie rod includes an elastic traction segment, a straight segment and a pull ring that are connected in sequence, and the elastic mesh structure is mainly composed of a plurality of layers of wavy metal strip circumferences and a plurality of anti-fatigue elastic connectors that are in mesh connection; each wavy metal strip circumference is a wavy metal strip wound into a closed loop, a plurality of wavy metal strip circumferences are sleeved outside the elastic membrane, and adjacent wavy metal strip circumferences are connected through a plurality of anti-fatigue elastic connectors; two ends of the anti-fatigue elastic connector are respectively connected between wave crests of two adjacent wavy metal strip circumferences to form a mesh that can radially and elastically expand and contract; the elastic traction segment of the tie rod has a plurality of stranded metal elastic tractive lines; one end of each stranded metal elastic tractive line is fixedly connected to a wave crest of a wavy metal strip circumference at an edge of the elastic mesh structure that is away from the pipe joint, the other end of each stranded metal elastic tractive line is connected to one end of the straight segment, and the other end of the straight segment is fixedly connected to the pull ring; and the frame receiving pipe is sleeved outside the elastic outer frame/inner hydraulic component.

When the elastic mesh structure is in an expanded state, the frame receiving pipe may be only sleeved outside the straight segment; and when the elastic mesh structure is in a contracted state, the frame receiving pipe may be only sleeved outside the elastic membrane to limit the elastic membrane.

The elastic traction segment, the wavy metal strip circumferences and the anti-fatigue elastic connectors may have a metal strip structure, and the straight segment and the pull ring may have a metal wire structure.

The anti-fatigue elastic connectors may have an S-shaped bent metal strip structure.

The elastic membrane may be fixedly connected to an inner wall of the elastic mesh structure, and can elastically expand and contract along with the elastic mesh structure.

The elastic membrane may be fixedly connected to an inner wall of the elastic outer frame, and can be elastically deformed accordingly. When in use, the elastic outer frame bulges out from the frame receiving pipe to closely adhere to an inner wall of a pipe blank, thereby playing a supporting role. The elastic membrane can be filled with a liquid and maintain a hydraulic pressure during a bending process to provide a supplementary support.

The elastic outer frame includes a tie rod and an elastic mesh structure. The elastic mesh structure plays a role of supporting an inner wall of a pipe blank, which has sufficient elasticity in a diameter direction. When a radial dimension of the elastic mesh structure increases, an axial dimension will decrease due to the linkage of the elastic mesh structure. The elastic mesh structure is composed of a plurality of layers of wavy metal strip circumferences and a plurality of anti-fatigue elastic connectors that are fixedly connected, and preferably, these members may be fixedly connected by welding. A function of the tie rod is to facilitate the manipulation of contraction and expansion of the elastic mesh structure. The tie rod has an elastic traction segment, a straight segment and a pull ring, and the elastic traction segment and the elastic mesh structure may be fixedly connected preferably by welding.

In the mandrel of the present disclosure, within a specified use diameter range, the elastic mesh structure in a metal conduit blank to be bent, after having expanded to closely adhere to an inner wall of the metal conduit blank, still shows a radial expansion trend and can provide support for a pipe wall.

The inner hydraulic component includes a liquid delivery pipe, a pipe joint, and an elastic membrane. The elastic membrane is fixedly attached to an inside of the elastic mesh structure, and can expand and contract along with the elastic mesh structure. An end of the elastic membrane close to the tie rod is closed, and an end away from the tie rod is provided with a pipe joint. The pipe joint is connected to the liquid delivery pipe, and the liquid delivery pipe is connected to a hydraulic system beyond the present disclosure. During the use of the present disclosure, the external hydraulic system can fill the inner chamber of the elastic membrane with a liquid through the liquid delivery pipe to supplement the supporting effect through a hydraulic pressure. The elastic membrane can well solve the sealing problem of liquid filling, and can fully ensure the stability of the supporting hydraulic pressure and prevent the filled liquid from polluting a working environment.

An outer diameter of the frame receiving pipe may be smaller than an inner diameter of a pipe blank to be bent, and before use, the frame receiving pipe can carry the elastic outer frame and be inserted into the pipe blank for the aircraft engine-specific metal conduit. The frame receiving pipe is provided to receive the elastic outer frame before and after the mandrel is in use, and the elastic outer frame is in an elastic contracted state when received.

Before the mandrel of the present disclosure is in use, the elastic mesh structure is in an elastic contracted state in the frame receiving pipe. When the mandrel of the present disclosure is in use, the frame receiving pipe carrying the elastic outer frame is inserted into a pipe blank to be bent from an end where the tie rod is located, such that the frame receiving pipe is approximately located at a bending segment of the pipe blank to be produced after bending. The tie rod is fixed and the frame receiving pipe is pulled out toward the end where the tie rod is located, or the frame receiving pipe is fixed and the tie rod is gently pushed toward the end where the liquid delivery pipe is located, such that the elastic mesh structure in a contracted state in the frame receiving pipe bulges out due to its own elasticity and is closely adhered to an inner wall of the pipe blank. Within an applicable diameter range of the present disclosure, the elastic mesh structure closely adhered to the pipe blank still has a tendency to expand outward, and the elasticity of the outer frame itself provides a first layer of prestress for the internal support for the bending segment of the pipe blank.

The bulged elastic outer frame drives the elastic membrane adhered inside to expand to form an inner chamber of the elastic membrane. The inner chamber of the elastic membrane is filled with a liquid through the liquid delivery pipe, such that the elastic membrane is closely adhered to the inner wall of the pipe blank and has some tendency to expand outward, which maintains a pressure in the inner chamber of the elastic membrane. The hydraulic pressure is used to provide a second layer of prestress for the internal support for the bending segment of the pipe blank. Moreover, according to actual processing needs, the hydraulic pressure in the inner chamber of the elastic membrane can be adjusted.

After the use is completed, the pressure in the inner chamber of the elastic membrane is released first, and the liquid in the inner chamber of the elastic membrane can flow out through the liquid delivery pipe. Subsequently, the frame receiving pipe is fixed and the tie rod is pulled toward the end where the tie rod is located, such that the elastic outer frame is compressed and received in the frame receiving pipe, and the mandrel of the present disclosure can be easily taken out from the inside of a bend.

Existing experimental and numerical simulation results show that, during the anti-wrinkling and anti-cross-section flattening forming of large-diameter and thin-walled bends, defects can be effectively prevented by applying only a small stress to an inside of a bending segment. This stress can be fully provided by the combination of the outer frame and the inner hydraulic pressure, and thus insufficient support is impossible.

Beneficial effects of the present disclosure: The present disclosure realizes the change of a radial dimension of the mandrel through an outer frame with an elastic mesh structure, and the same mandrel can be used for the bending of pipe blanks of all dimensions within a specified diameter range, which reduces the production cost and storage cost of mandrels.

In the present disclosure, on the basis of the elastic outer frame, a liquid-filled chamber is added inside to make a contact between the mandrel and an inner wall of a bend approximate to a surface contact, which strengthens the supporting effect and improves the forming quality of a large-diameter and thin-walled bend.

The present disclosure solves the problem that a bending angle of the multi-ball segment mandrel is limited, and there is no interfere among the structures in the present disclosure. Therefore, the present disclosure is fully suitable for the processing of bends with large bending angles.

The mandrel of the present disclosure has a variable use diameter and thus can adapt to the processing needs of large-diameter and thin-walled bends with different dimensions, which saves the production cost. Support is provided for a bend through the combination of the elasticity of the elastic outer frame in radial expansion and the hydraulic pressure in the inner chamber of the elastic membrane, which effectively prevents the forming defects of wrinkling and cross-section flattening in a bending process.

In the figures: 1: frame receiving pipe; 2: elastic outer frame; 3: inner hydraulic component; 4: liquid delivery pipe; 5: pipe joint; 6: elastic membrane; 7: wavy metal strip circumference; 8: anti-fatigue elastic connector; 9: elastic traction segment; 10: straight segment; 11: pull ring; 12: tie rod; 13: elastic mesh structure; and 14: pipe blank.

DETAILED DESCRIPTION OF THE EMBODIMENTS

The present disclosure will be explained in detail below with reference to the accompanying drawings.

Figure 1:
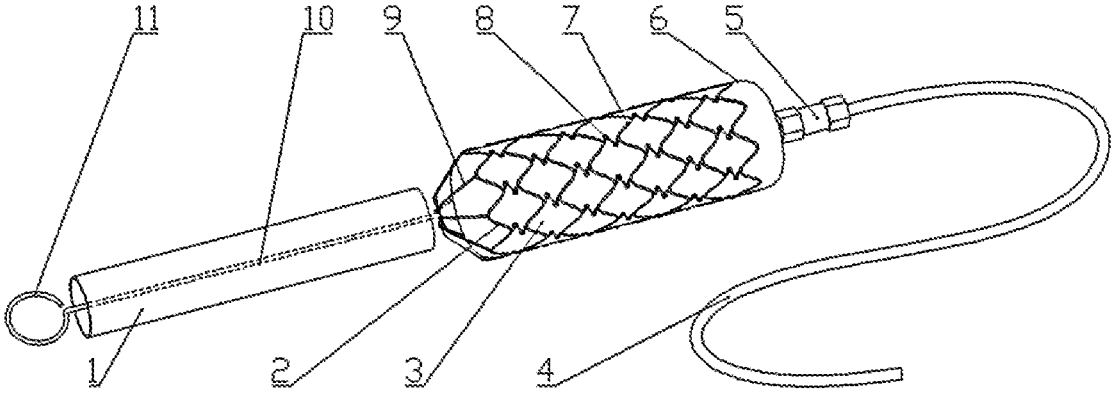
FIG. 1 is a schematic diagram illustrating the overall structure of the elastic double-support variable-diameter mandrel of the present disclosure.
Figure 2:
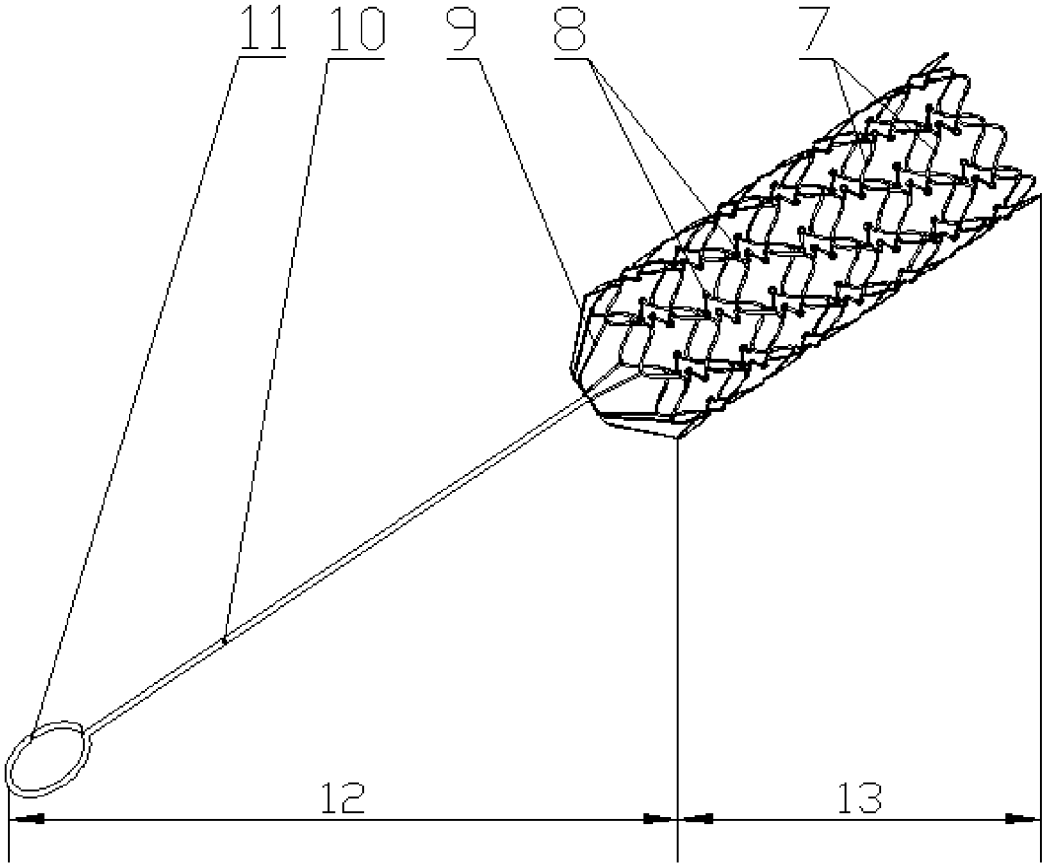
FIG. 2 is a schematic diagram illustrating the structure of the elastic outer frame according to the present disclosure.
Figure 3:
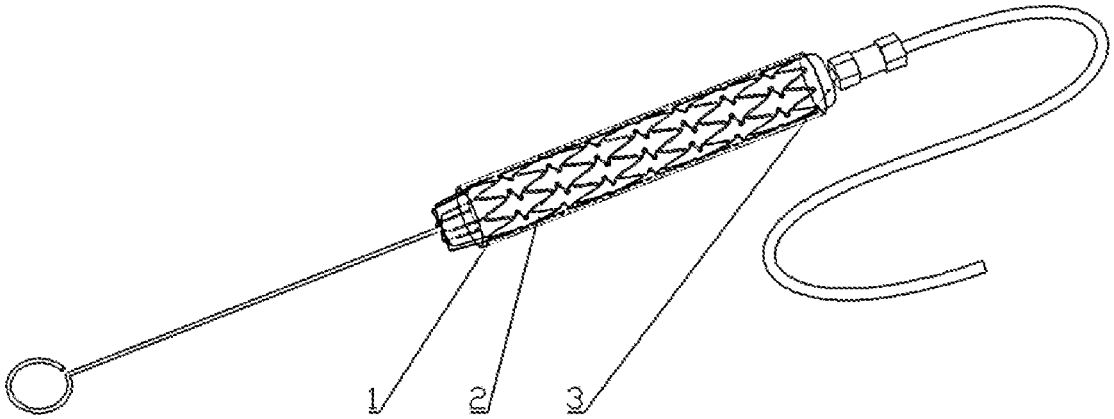
FIG. 3 is a schematic diagram of the elastic outer frame in a contracted and received state according to the present disclosure.

As shown in FIG. 1 to FIG. 3, a specific implementation includes a frame receiving pipe 1, an elastic outer frame 2, and an inner hydraulic component 3; the inner hydraulic component 3 includes a liquid delivery pipe 4, a pipe joint 5, and an elastic membrane 6; an inner chamber of the elastic membrane 6 is filled with a liquid; a tail end of the elastic membrane 6 is provided with an opening, the opening communicates with one end of the liquid delivery pipe 4 through the pipe joint 5, one end of the elastic membrane 6 away from the pipe joint 5 is closed, and the other end of the liquid delivery pipe 4 is connected to an external hydraulic system; and the liquid delivery pipe 4 is configured to fill the inner chamber of the elastic membrane 6 with a liquid.

The elastic outer frame 2 is a flexible single unit mainly composed of a tie rod 12 and an elastic mesh structure 13. The tie rod 12 includes an elastic traction segment 9, a straight segment 10 and a pull ring 11 that are connected in sequence. The elastic mesh structure 13 is mainly composed of a plurality of layers of wavy metal strip circumferences 7 and a plurality of anti-fatigue elastic connectors 8 that are in mesh connection. Each wavy metal strip circumference 7 is a wavy metal strip wound into a closed loop, a plurality of wavy metal strip circumferences 7 are sleeved outside the elastic membrane 6, and adjacent wavy metal strip circumferences 7 are connected through a plurality of anti-fatigue elastic connectors 8. Two ends of the anti-fatigue elastic connector 8 are respectively connected between wave crests of two adjacent wavy metal strip circumferences 7 to form a mesh that can radially and elastically expand and contract. That is, in two adjacent wavy metal strip circumferences 7, a wave crest faces a wave crest and a wave trough faces a wave trough, such that waves are staggered; and an anti-fatigue elastic connector 8 is welded between opposite wave crests of two adjacent wavy metal strip circumferences. The elastic membrane 6 is fixedly connected to an inner wall of the elastic mesh structure 13 and can elastically expand and contract along with the elastic mesh structure 13. Preferably, the two may be bonded together using an adhesive, such that the elastic membrane 8 can expand or contract radially along with the elastic outer frame 2. When the inner chamber of the elastic membrane 6 is filled with a liquid, the sealing performance is prominent, such that a stable hydraulic support can be provided for an inner wall of a pipe blank to be bent.

The elastic traction segment 9 of the tie rod 12 has a plurality of stranded metal elastic tractive lines; one end of each stranded metal elastic tractive line is fixedly connected to a wave crest of a wavy metal strip circumference 7 at an edge of the elastic mesh structure 13 that is away from the pipe joint 5, the other end of each stranded metal elastic tractive line is connected to one end of the straight segment 10, and the other end of the straight segment 10 is fixedly connected to the pull ring 11; the pull ring 11 is provided to connect a traction driver at the other end when a metal conduit is bent; and the frame receiving pipe 1 is sleeved outside the elastic outer frame 2/inner hydraulic component 3.

In a specific implementation, the straight segment 10 and the pull ring 11 have a metal wire structure, the wavy metal strip circumferences 7, the elastic traction segment 9 and the anti-fatigue elastic connectors 8 have a metal strip structure, and the anti-fatigue elastic connectors 8 have an S-shaped bent metal strip structure.

Figure 5A:
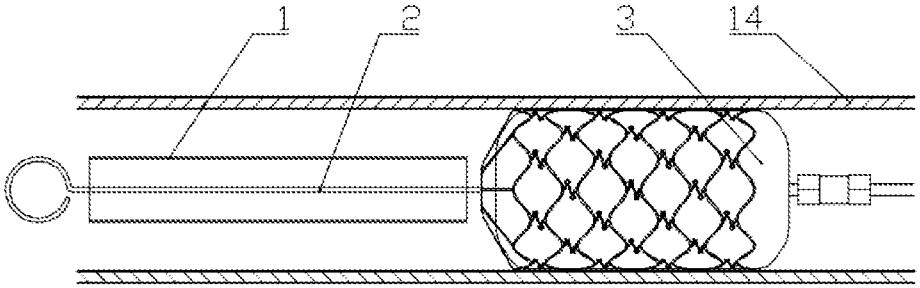
FIG. 5A and FIG. 5B show the shape changes of the elastic outer frame in pipe blanks with different diameters when the mandrel of the present disclosure is in use.
Figure 5B:
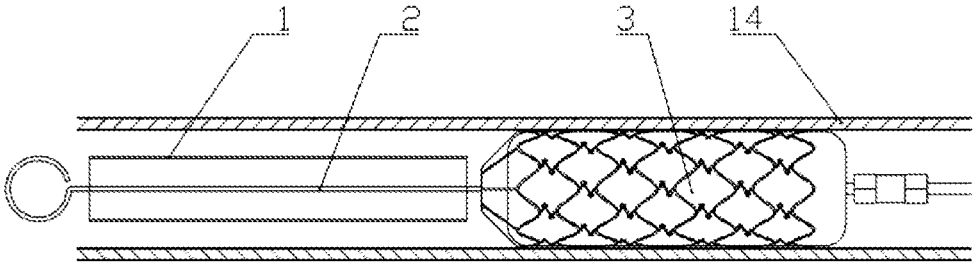
Figure 6:
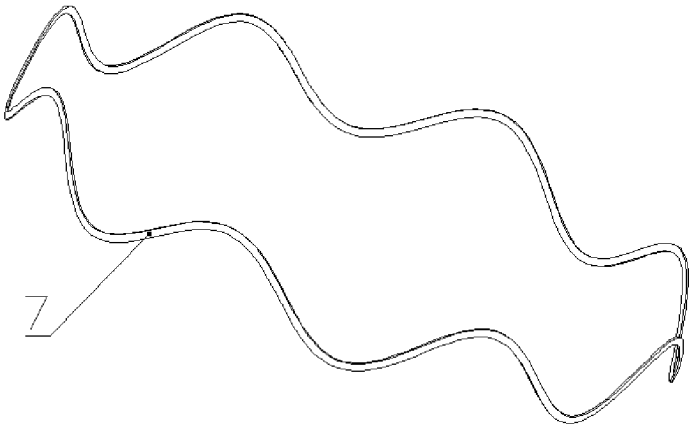
FIG. 6 is a schematic diagram of the wavy metal strip circumference used for the elastic outer frame according to the present disclosure.

As shown in FIGS. 5A and 5B, when the elastic mesh structure 13 is in an expanded state, the frame receiving pipe 1 is only sleeved outside the straight segment 10.

Figure 4:
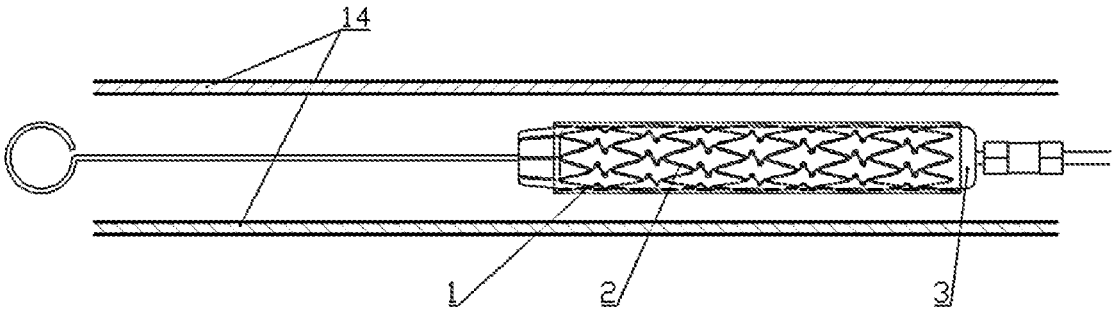
FIG. 4 is a schematic diagram illustrating a relationship between the mandrel and a pipe blank when the elastic outer frame is not expanded according to the present disclosure.

As shown in FIG. 4, when the elastic mesh structure 13 is in a contracted state, the frame receiving pipe 1 is only sleeved outside the elastic membrane 6 to limit the elastic membrane 6.

A preferred manufacturing solution of this structure is as follows: A metal sheet made of a suitable material is cut into wavy strips, a wavy metal strip of a suitable length is taken and wound into a circle, and a resulting product is subjected to welding at a connection and then to heat treatment for giving radial elasticity and shaping. Given that a connector for the wavy metal strip circumferences 7 needs to undergo an axial tension when the frame is received or bulges out, and may undergo a tension or a pressure in a tangential direction (approximately axial) of a bending curve because it is not sure whether the connector is at an inner bending side or an outer bending side during bending, an anti-fatigue metal sheet is cut into zigzag connectors and then the connectors are subjected to heat treatment. When wavy metal strip circumferences are arranged in each layer, wave crests and wave troughs are staggered, and the anti-fatigue elastic connector 8 is welded between adjacent wave crests to make a plurality of layers of wavy metal strip circumferences form an integrated elastic mesh. The tie rod 12 has an elastic traction segment 9, a straight segment 10 and a pull ring 11. The pull ring 11 is formed by bending one end of the straight segment 10, and the other end of the straight segment 10 is fixedly connected to a center of the elastic traction segment 9 preferably by welding. The elastic traction segment 9 is divided into a plurality of strands, and each strand is welded to a wave crest of the wavy metal strip circumference at the outermost edge of the elastic mesh structure 13. There are also other manufacturing solutions for the elastic outer frame 2. For example, a sheet can be directly cut into a mesh and then welded into a circle, or other suitable non-metallic materials can be used.

Before the mandrel of the present disclosure is in use, the mandrel as a whole is generally in a received state shown in FIG. 3, in which case, the contracted elastic outer frame 2 and the elastic membrane 6 of the inner hydraulic component 3 are received in the frame receiving pipe 1.

As shown in FIG. 4, when the mandrel of the present disclosure is in use, from an end where the tie rod 12 is located, the frame receiving pipe 1 is inserted into a pipe blank to be bent and roughly placed at a bending segment during processing. A diameter of the liquid delivery pipe 4 is much smaller than that of the pipe blank and can extend out from an inside of the pipe blank. The tie rod 12 is fixed and the frame receiving pipe 1 is gently pulled toward an end where the pull ring 11 is located, or the frame receiving pipe 1 is fixed and the tie rod 12 is gently pushed toward an end where the liquid delivery pipe 4 is located, such that the contracted elastic mesh structure 13 naturally bulges out to make the wavy metal strip circumference 7 closely adhered to an inner wall of the pipe blank and still shows a radial expansion trend, which causes the inner wall of the bending segment of the pipe blank to receive a first layer of supporting pressure.

During bulging, the elastic mesh structure 13 expands radially to adhere to the inner wall of the pipe blank, and after adhering to the inner wall, the elastic mesh structure stops expanding due to a force balance caused by a counterforce of the pipe wall. This elastic feature makes the present disclosure suitable for the bending of pipe blanks with different diameters. When a radial dimension of the elastic mesh structure 13 increases, an axial dimension will decrease due to the linkage of the elastic mesh structure, and vice versa. The radial expansion of the elastic outer frame 2 will drive the elastic membrane 6 adhered to the inner wall to expand together, and a volume of the inner chamber of the elastic membrane will increase. The external hydraulic system connected to the liquid delivery pipe 4 can replenish the liquid in the inner chamber of the elastic membrane to make the elastic membrane 6 adhered to a pipe wall and have a radial expansion trend, and then a pressure in the inner chamber of the elastic membrane is maintained through a component in the external hydraulic system. The liquid pressure in the inner chamber of the elastic membrane can provide a second layer of supporting pressure for the inner wall of the bending segment of the pipe blank, and the approximate surface support fully guarantees the supporting effect of the mandrel. In a preferred solution, a pressure gauge can be provided between the liquid delivery pipe 4 and the pipe joint 5 to accurately control a supporting pressure of the mandrel to a bend according to actual processing parameters.

As shown in FIG. 3, FIG. 4, and FIGS. 5A and 5B, when the mandrel of present disclosure is in use, the mandrel as a whole will change from the received state shown in FIG. 3 and FIG. 4 to the ejected state shown in FIGS. 5A and 5B.

After the use is completed, the pressure in the inner chamber of the elastic membrane is released first, and the liquid in the inner chamber can flow out through the liquid delivery pipe 4. The frame receiving pipe 1 is fixed and the tie rod 12 is pulled toward the end where the pull ring 11 is located, such that the elastic traction segment 9 of the tie rod 12 is first constrained by an edge of the frame receiving pipe 1 to contract toward the inside of the pipe, and then drives wavy metal strip circumferences 7 on the elastic mesh structure 13 that are welded to the tie rod to contract radially, and then the frame is received in the frame receiving pipe 1. The tension is transmitted to the next layer of circumferences through the anti-fatigue elastic connectors 8. Under the combined action of the tension and the edge constraint of the frame receiving pipe 1, the elastic outer frame 2 will be received in the frame receiving pipe 1, and the mandrel changes from the state shown in FIGS. 5A and 5B to the state shown in FIG. 3 and FIG. 4. Finally, the frame receiving pipe 1 is taken out from a bend.

When the mandrel of the present disclosure is in use, a radial dimension of the wavy metal strip circumference 7 changes, an anti-fatigue elastic connector 8 at an outer bending side during bending is stretched, and an anti-fatigue elastic connector 8 at an inner bending side during bending is compressed. During a process of pulling the tie rod 12 to make the entire elastic outer frame 2 received in the frame receiving pipe 1, deformations of members such as the wavy metal strip circumference 7, the anti-fatigue elastic connector 8, and the elastic traction segment 9 are all elastic deformations.

FIG. 5A shows the state of the elastic outer frame 2 in a pipe blank 14 with a large diameter to be bent, and FIG. 5B shows the state of the elastic outer frame 2 in a pipe blank 14 with a small diameter to be bent. Compared with FIG. 5B, in FIG. 5A, the elastic mesh structure 13 of the elastic outer frame 2 is sparser and has a smaller axial dimension.

What is claimed is:

1. An elastic double-support variable-diameter mandrel for bending of an aircraft engine-specific metal conduit, comprising a frame receiving pipe, an elastic outer frame, and an inner hydraulic component, wherein the inner hydraulic component, a pipe joint, and an elastic membrane;

an inner chamber of the elastic membrane is filled with a liquid, a tail end of the elastic membrane is provided with an opening, the opening communicates with a first end of the liquid delivery pipe through the pipe joint, and a second end of the liquid delivery pipe is connected to an external hydraulic system;

the liquid delivery pipe is configured to fill the inner chamber of the elastic membrane with the liquid;

the elastic outer frame is a flexible single unit composed of a tie rod and an elastic mesh structured;

the tie rod comprises an elastic traction segment, a straight segment and a pull ring, wherein the elastic traction segment, the straight segment and the pull ring are connected in sequence;

the elastic mesh structure comprises a plurality of layers of wavy metal strip circumferences and a plurality of anti-fatigue elastic connectors, wherein the plurality of layers of wavy metal strip circumferences and the plurality of anti-fatigue elastic connectors are in a mesh connection;

each wavy metal strip circumference of the plurality of layers of wavy metal strip circumferences is a wavy metal strip wound into a closed loop, the plurality of layers of wavy metal strip circumferences are sleeved outside the elastic membrane, and adjacent wavy metal strip circumferences are connected through the plurality of anti-fatigue elastic connectors;

two ends of each of the plurality of anti-fatigue elastic connector are respectively connected between wave crests of two adjacent wavy metal strip circumferences to form a mesh wherein the mesh radially and elastically expands and contracts;

the elastic traction segment of the tie rod has a plurality of stranded metal elastic tractive lines;

a first end of each stranded metal elastic tractive line of plurality of stranded metal elastic tractive lines is fixedly connected to a wave crest of a wavy metal strip circumference at an edge of the elastic mesh structure, wherein the wave crest of the wavy metal strip circumference is away from the pipe joint;

a second end of the each stranded metal elastic tractive line is connected to a first end of the straight segment, and a second end of the straight segment is fixedly connected to the pull ring; and the frame receiving pipe is sleeved outside the elastic outer frame or the inner hydraulic component.

2. The elastic double-support variable-diameter mandrel according to claim 1, wherein when the elastic mesh structure is in an expanded state, the frame receiving pipe is only sleeved outside the straight segment; and when the elastic mesh structure is in a contracted state, the frame receiving pipe is only sleeved outside the elastic membrane to limit the elastic membrane.

3. The elastic double-support variable-diameter mandrel according to claim 1, wherein the elastic traction segment, the plurality of wavy metal strip circumferences and the plurality of anti-fatigue elastic connectors have a metal strip structure, and the straight segment and the pull ring have a metal wire structure.

4. The elastic double-support variable-diameter mandrel according to claim 1, wherein the plurality of anti-fatigue elastic connectors have an S-shaped bent metal strip structure.

5. The elastic double-support variable-diameter mandrel according to claim 1, wherein the elastic membrane is fixedly connected to an inner wall of the elastic mesh structure, and elastically expands and contracts along with the elastic mesh structure.

6. The elastic double-support variable-diameter mandrel according to claim 1, wherein an outer diameter of the frame receiving pipe is smaller than an inner diameter of a pipe blank to be bent; and before use, the frame receiving pipe carries the elastic outer frame and is inserted into the pipe blank for the aircraft engine-specific metal conduit.

* * * * *